US007980788B2

(12) United States Patent
Hoess

(10) Patent No.: US 7,980,788 B2
(45) Date of Patent: Jul. 19, 2011

(54) CONSTRUCTION MACHINE

(75) Inventor: Franz Seraph Hoess, Aichach (DE)

(73) Assignee: Bauer Maschinen GmbH, Schrobenhausen (DE)

( * ) Notice: Subject to any disclaimer, the term of this patent is extended or adjusted under 35 U.S.C. 154(b) by 76 days.

(21) Appl. No.: 12/149,508

(22) Filed: May 2, 2008

(65) Prior Publication Data

US 2008/0279638 A1 Nov. 13, 2008

(30) Foreign Application Priority Data

May 10, 2007 (EP) ..... 07 009 412

(51) Int. Cl.
*E02D 7/18* (2006.01)
*F01M 9/00* (2006.01)

(52) U.S. Cl. ..... 405/274; 475/159; 74/467; 184/6.12; 60/456

(58) Field of Classification Search ..... 475/159; 74/467; 184/6.12; 60/456; 405/274
See application file for complete search history.

(56) References Cited

U.S. PATENT DOCUMENTS

| | | | | |
|---|---|---|---|---|
| 4,437,358 | A * | 3/1984 | Kubo et al. | 477/62 |
| 4,516,655 | A | 5/1985 | Donahue et al. | |
| 4,751,858 | A * | 6/1988 | Iwatsuki | 477/164 |
| 5,419,130 | A | 5/1995 | Rückgauer et al. | |
| 5,961,419 | A * | 10/1999 | Hisano et al. | 477/97 |
| 2006/0048509 | A1 * | 3/2006 | Umemura et al. | 60/456 |

FOREIGN PATENT DOCUMENTS

| | | |
|---|---|---|
| DE | 69 50 437 | 2/1974 |
| DE | 25 24 808 | 6/1976 |
| DE | 20 2004 019 034 | 4/2005 |
| EP | 0 534 067 | 3/1993 |
| EP | 1 245 737 | 10/2002 |
| FR | 2 775 732 | 9/1999 |
| GB | 1 435 499 | 5/1976 |

* cited by examiner

*Primary Examiner* — Sunil Singh
(74) *Attorney, Agent, or Firm* — Jacobson Holman PLLC

(57) ABSTRACT

The invention relates to a construction machine comprising a transmission, at least one hydraulic drive and a hydraulic circuit for supplying the hydraulic drive with hydraulic fluid, wherein at least one lubrication line is branched off from the hydraulic circuit, by means of which the transmission can be supplied with hydraulic fluid as a lubricant. The invention is characterized in that a dosing device is provided on the lubrication line, with which the supply of lubricant can be changed depending on an operating condition of the transmission.

16 Claims, 1 Drawing Sheet

CONSTRUCTION MACHINE

BACKGROUND OF THE INVENTION

1. Field of the Invention

The invention relates to a construction machine, in particular for generating vibrations. A construction machine of such type is designed with a transmission, at least one hydraulic drive and a hydraulic circuit for supplying the hydraulic drive with hydraulic fluid, wherein at least one lubrication line is branched off from the hydraulic circuit, by means of which the transmission can be supplied with hydraulic fluid as a lubricant.

2. Description of related art including information disclosed under 37 CFR §§1.97 and 37 CFR 1.98

A generic construction machine is known from DE 101 15 260 C2. The teaching of this printed publication is to connect the hydraulic circuit of a hydraulic drive with the lubricating circuit of a transmission so that the hydraulic fluid serves as a lubricating oil.

A vibrator used for homogenizing mixtures that has a combined hydraulic-lubricant-circuit is known from U.S. Pat. No. 4,039,167.

The object of the invention is to improve a generic construction machine in such a manner that whilst offering high versatility a particularly high operational reliability is achieved.

BRIEF SUMMARY OF THE INVENTION

In accordance with the invention the object is solved by a construction machinehaving a transmission, at least one hydraulic drive and a hydraulic circuit for supplying the hydraulic drive with hydraulic fluid, wherein at least one lubrication line is branched off from the hydraulic circuit, by means of which the transmission can be supplied with hydraulic fluid as a lubricant, wherein on the lubrication line a dosing device is provided, with which the supply of lubricant can be changed depending on an operating condition of the transmission.

The construction machine according to the invention is characterized in that on the lubrication line a dosing device is provided, with which the supply of lubricant can be changed depending on an operating condition of the transmission.

A fundamental idea of the invention can be seen in the fact that a dosing device is provided for the lubricant, with which the flow of lubricant flowing in the lubrication line can be set selectively, in particular controlled and/or regulated, between the hydraulic circuit and the transmission depending on the operating condition of the transmission. The invention is based on the idea that the demand for lubricant by the transmission can depend on its operating condition. A variable demand for lubricant can result for instance from the fact that in the case of higher rotational speeds of the transmission the lubricant stays for a shorter period of time at the lubricating points and/or that a greater amount of heat is to be dissipated. The variable flow of lubricant according to the invention can ensure in this connection a reliable lubrication even in the case of high rotational speeds of the transmission and at the same time assurance is made that in the case of low rotational speeds no unnecessarily high quantity of fluid is drawn from the hydraulic circuit leading perhaps to an undesired high quantity of lubricant accumulating in the lubricant-oil sump of the transmission.

Likewise, a demand for lubricant by the transmission depending on the operating condition can in particular be the case if the discharge of lubricant from the transmission is effected depending on the operating condition, more particularly depending on the rotational speed. In such case assurance can be made according to the invention that the ratio between the supply rate and the discharge rate of lubricant is always constant at the transmission irrespective of the operating condition. In particular, the rates can be set equal. In this way it can be ensured that even during longer periods of operation the transmission is neither filled to the maximum with lubricant nor does it run dry. In order to prevent the transmission from being filled to the maximum with lubricant provision is preferably made for the discharge rate from the transmission to be higher than the supply rate to the transmission. To prevent in this case the discharge pump from running dry balancing means can be provided that lead a part of the discharged lubricant back into the transmission.

By the term operating condition the rotational speed of the transmission can be understood for example. However, the operating condition can also be the filling level of lubricant in the transmission for example.

By means of the invention it can be ensured in particular that lubricant is passed into the transmission only during operation of the transmission, whereby prevention can be made of the transmission filling to the maximum with lubricant in the inoperative condition in particular. The supply of lubricant depending on the operating condition in accordance with the invention permits a dosed force-feed lubrication of the transmission.

The invention renders it possible to operate the construction machine at a variable rotational speed of the transmission, in which case an especially reliable lubrication of the transmission is provided irrespective of the rotational speed. Therefore, in accordance with the invention a construction machine is obtained that is both especially versatile and reliable. If the construction machine is designed for generating vibrations, especially as a vibrator, the variable rotational speed of the transmission makes it possible to drive different kinds of construction elements into the ground in a smooth and reliable manner even when varying soil geologies are prevailing.

In accordance with the invention it is especially advantageous for the dosing device to have a dosing pump that is coupled mechanically to the transmission. According to this embodiment the dosing pump that is responsible for conveying lubricant into the transmission is driven by at least one element of the transmission. The mechanical coupling permits a condition-dependent actuation of the dosing device in a particularly simple and reliable manner. In principle, it would also be possible e.g. to determine the operating condition of the transmission by means of an electronic sensor and to set the supply of lubricant to the transmission by means of an electronic setting member.

Furthermore, according to the invention it is especially preferred that a lubricant return device is provided with which lubricant can be discharged from the transmission depending on the operating condition of the transmission. According to this embodiment both the supply rate of lubricant to the transmission and the discharge rate of lubricant from the transmission is set depending on the operating condition.

It is particularly advantageous for the lubricant return device to have at least one lubricant return line, on which a lubricant return pump is arranged. By preference, the lubricant return pump is coupled mechanically to the transmission. Similarly to the dosing pump, the lubricant return pump according to this embodiment is driven mechanically by an element of the transmission. Basically, it would also be possible to set the discharge of lubricant from the transmission by an electronic setting member that is operated on the basis of the sensor-determined operating condition.

In connection with a discharge of lubricant from the transmission depending on the rotational speed the invention offers an especially wide range of advantages. If, in this case, the supply of lubricant to the transmission were set constant, as known from prior art, the pump size of the lubricant return pump would have to be dimensioned such that the supplied lubricant could be pumped out reliably even when the lowest rotational speed of the transmission is present. However, this brings about a certain over-dimensioning of the lubricant return pump. If the transmission were operated in this case at a higher rotational speed, in particular at nominal rotational speed, the over-dimensioned pump might convey more oil than is available in the transmission sump. This might in turn have the effect that undesired large amounts of air enter the lubricant return line and is conveyed from there into the hydraulic system of the base device which can lead to an undesired frothing of the oil. By comparison, according to the invention the amount of lubrication fluid supplied to the transmission is also set depending on the rotational speed. Hence, according to the invention the supplied and discharged amount of lubricant can be in a fixed ratio to each other. More particularly, according to the invention the lubricant return pump does not have to be over-dimensioned whereby an undesired oil frothing is counteracted. For best suitability, the amount conveyed by the dosing pump, preferably the amount of lubricant conveyed both by the dosing pump and by the lubricant return pump, is at any rate proportional to the rotational speed of the transmission.

The operational reliability can be increased further by the fact that in particular on the side of the lubricant return pump facing away from the transmission a balancing line is branched off from the lubricant return line, which leads into the transmission, preferably via a throttle. The balancing line can serve for example to return gas proportions, that are perhaps discharged from the transmission by the lubricant return pump, back to the transmission.

Moreover, by means of a balancing line a complete running-dry of the transmission can be counteracted.

To prevent in particular an undesired loss of fluid it is of advantage that a leak oil line is provided for discharging leak oil from the hydraulic drive and/or from the dosing pump. In order to reduce the amount of equipment involved it is advantageous that a common leak oil line is provided for discharging leak oil both from the hydraulic drive and from the dosing pump.

Furthermore, according to the invention it is preferred that a relief line is provided, with which the lubrication line, the lubricant return line and/or the leak oil line are each in line-connection via a pressure-limiting valve, with the relief line leading into the transmission. As a result, an excess pressure protection can be realized in an especially simple manner. For best suitability, the lubricant return line is in line-connection with the relief line downstream of the lubricant return pump.

The hydraulic fluid supplied as a lubricant to the transmission can be leak oil of the hydraulic drive in particular. In this case the lubrication line can be branched off from a leak oil line of the hydraulic circuit. Alternatively or additionally provision can be made for the transmission to be supplied with oil returned to the hydraulic drive. Therefore, a preferred improvement of the invention resides in the fact that the lubrication line is branched off from a return-flow line of the hydraulic circuit. According to this embodiment lubricant is diverted from the flow leaving the hydraulic motor. As a rule, in the leak oil line and/or the return-flow line of the hydraulic circuit comparatively low hydraulic pressure is present that is especially suitable for the lubricating function. It is also possible to supply to the transmission both return oil and leak oil as a lubricant, whereby an especially reliable supply of lubricant is ensured. For instance provision can be made for the transmission to be supplied with a basic flow from the return-flow line and with an additional flow supplied from the leak oil line depending on the operating condition.

Basically, according to the invention provision can be made for the hydraulic drive and the transmission to be actuated independently of each other. However, it is especially advantageous that the hydraulic drive is arranged for actuation of the transmission. According to this embodiment the hydraulic drive is suitably provided on a drive shaft of the transmission. The transmission can be a rotary transmission for example, more particularly a gear transmission. By preference, the hydraulic drive is a hydraulic rotary motor.

A construction machine that is particularly versatile and/or efficient is given in that at least two hydraulic drives with a respective return-flow line are provided for driving the transmission. To achieve an especially reliable lubrication it is, in particular, advantageous for the lubrication line to be in line-connection with the two return-flow lines.

For example for functional testing of the lubrication it is useful if a pressure switch is provided on the lubrication line, in particular on the side of the dosing pump facing towards the transmission.

To generate vibrations in an especially easy way it is of advantage for at least one unbalanced mass to be arranged on the transmission. For best suitability, several unbalanced masses are provided, the phase position of which can be changed in order to set the vibrational amplitude.

By preference, the construction machine according to the invention, which can also be referred to as a vibrator, is a soil working device, by means of which construction elements, such as foundation elements, sheet piles and/or soil working tools can be driven into the ground. For this purpose a mounting for a construction element is preferably provided on the transmission. The construction machine can be a top vibrator or a depth vibrator for example. The construction machine can also be provided for soil compaction in particular. The fluids in accordance with the invention are suitably liquids, especially oil. For actuation of the hydraulic drive at least one hydraulic pump is suitably provided that is arranged in the hydraulic circuit. Advantageously, the hydraulic pump is provided on a carrier device, on which the transmission is arranged in a displaceable manner together with the hydraulic drive. It is especially advantageous that means are provided for setting the rotational speed of the hydraulic drive. To this end the hydraulic pump is suitably provided in an adjustable manner. According to the invention the hydraulic circuit can be designed as an open or closed circuit.

The invention also comprises a method for producing a sheet pile wall, in which sheet piles are acted upon by mechanical vibration and driven into the ground by means of a construction machine according to the invention.

In the following the invention is described in greater detail by way of preferred embodiments that are shown schematically in the accompanying drawing, wherein:

DETAILED DESCRIPTION OF THE INVENTION

Figure 1:
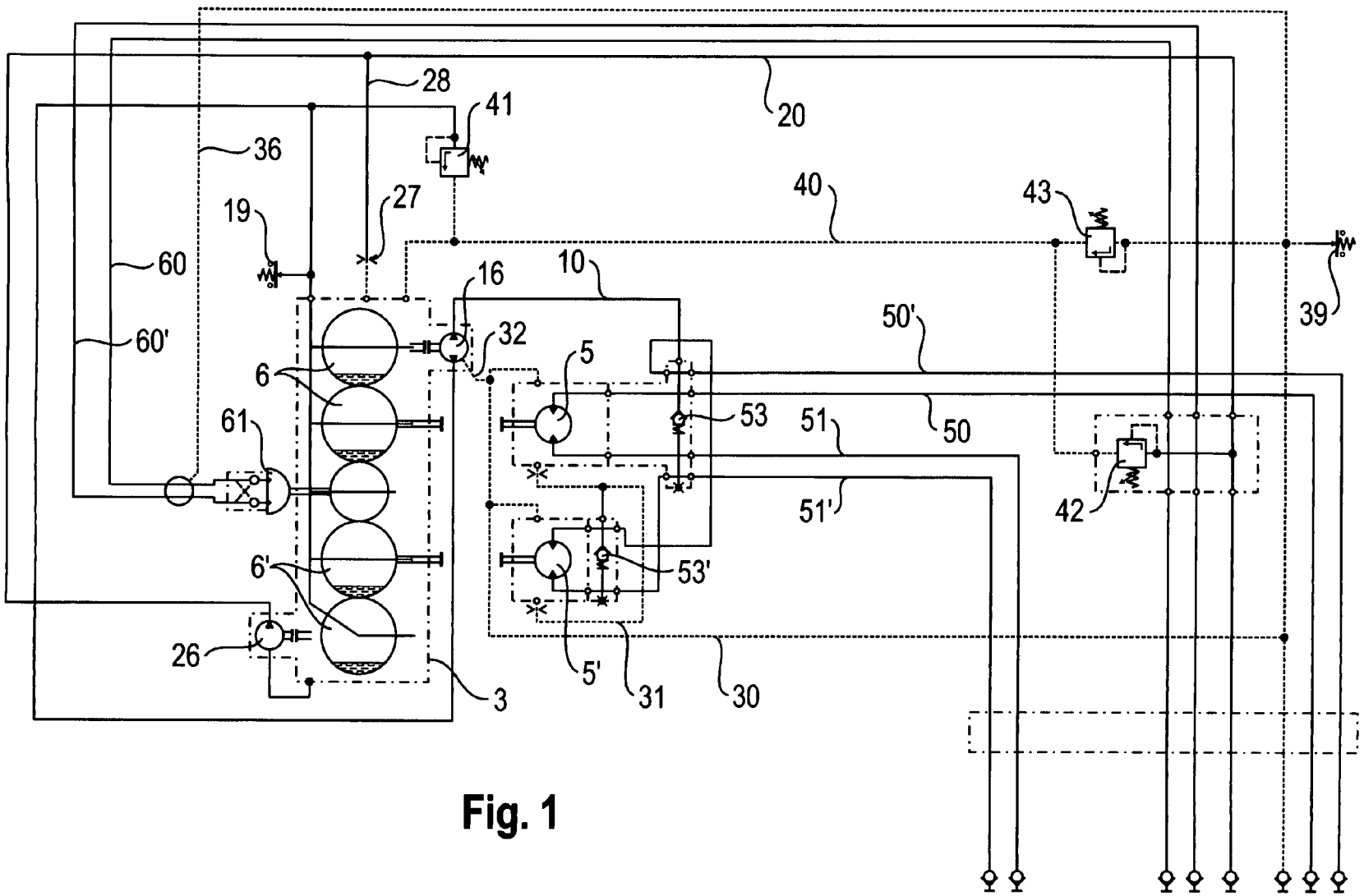
FIG. 1 shows the hydraulic diagram of a construction machine according to the invention.

A construction machine in accordance with the invention is shown in FIG. 1. The construction machine designed as a vibrator has a transmission 3, in which two first unbalanced masses 6 and two second unbalanced masses 6' are provided for generating vibrations. On the transmission 3 a hydraulic swing motor 61 is arranged, by means of which the phase position of the first unbalanced mass 6 can be set relative to the second unbalanced mass 6'. For actuation of the hydraulic swing motor 61 two operating lines 60, 60' for hydraulic fluid are provided on the said motor.

To drive the transmission 3 two hydraulic drives 5, 5' are provided that are mechanically connected with the unbalanced masses 6, 6'. To supply hydraulic fluid to the hydraulic drive 5 a supply line 51 is arranged thereon. By analogy, to supply hydraulic fluid to the hydraulic drive 5' a supply line 51' is arranged thereon. To discharge hydraulic fluid from the hydraulic drives 5 and 5' a return-flow line 50 and 50' respectively is provided on the said drives. Between the supply line 51 and the return-flow line 50 of the hydraulic drive 5 a check valve 53 is arranged that permits a flow from the return-flow line 50 to the supply line 51 and blocks an opposite-directed flow. A check valve 53' of analogous design is present between the supply line 51' and the return-flow line 50' of hydraulic drive 5'. For actuation of the hydraulic drives 5, 5' two hydraulic pumps not shown in the Figures are provided that are connected with lines 50 and 51 and respectively 50' and 51'.

In accordance with the invention provision is made for operating fluid for the hydraulic drives 5, 5' to be also used for lubrication of the transmission 3. For this purpose a lubrication line 10 is provided that is in line-connection both with the return-flow line 50 of hydraulic drive 5 and with the return-flow line 50' of hydraulic drive 5' and is thereby able to discharge from the return-flow lines 50, 50' fluid back-flowing to the hydraulic drives 5, 5' and to supply this fluid to the transmission 3 as a lubricating medium. In the transmission 3 fluid is passed from the lubrication line 10 to the lubricating points of the transmission 3.

To set the quantity of fluid conveyed via the lubrication line 10 to the transmission 3 a dosing pump 16 is arranged on the lubrication line 10. The dosing pump 16 is connected mechanically with the transmission 3, more particularly with the unbalanced masses 6, 6', so that the rotational speed of the pump and therefore the flow of lubricating medium conveyed by the dosing pump 16 is determined by the rotational speed of the transmission, in particular by being proportional thereto.

In the area of the transmission 3 a pressure switch 19 is provided on the lubrication line 10, which closes upon a previously determined pressure and in this way permits monitoring of a correct lubrication.

To discharge lubricant from the transmission 3 a lubricant return line 20 is provided that leads into the sump of the transmission 3. Through this lubricant return line 20 lubricant is returned from the transmission 3 to a collecting tank not shown in the Figures, from which fluid can again be supplied by means of the hydraulic pumps to the supply lines 51, 51' of the hydraulic drives 5, 5'. On the lubricant return line 20 a lubricant return pump 26 is arranged that is mechanically connected to the transmission 3 just as the dosing pump 16 so that the conveying capacity of the said lubricant return pump equally depends on the rotational speed of the transmission 3. Due to the fact that the conveying capacity of both pumps 16 and 26 depends on the rotational speed assurance is made that during operation the transmission 3 is neither filled to the maximum with lubricant nor does it run dry.

With the lubricant return line 20 a balancing line 28 is connected that leads into the transmission 3 via a throttle 27 and can serve for example to return gas proportions from the lubricant return line 20 to the transmission 3.

To discharge leak oil from the two hydraulic drives 5, 5' a leak oil line 30 is provided. This leak oil line 30 joins with another leak oil line 36 of the hydraulic swing motor 61 to a common leak oil return line. In addition, a further leak oil line 31 is provided on the two hydraulic drives 5, 5', which connects the two hydraulic drives 5, 5' to each other.

Through a connecting line 32 the dosing pump 16 is in line-connection with the leak oil line 30 and perhaps also with the leak oil line 31 of the hydraulic drives 5, 5'. In this way the dosing pump can draw fluid from the leak oil lines 30 and/or 31 and supply it as a lubricant to the transmission 3. However, the connecting line 32 can also serve for discharging leak oil that accumulates on the dosing pump 16.

In addition, the device depicted in FIG. 1 has a relief line 40, into which the lubrication line 10 via a pressure-limiting valve 41, the lubricant return line 20 via a pressure-limiting valve 42 and the leak oil line 36 via a pressure-limiting valve 43 are led. The relief line 40 leads into the transmission 3 and is able to discharge fluid from the lines 10, 20 and/or 30 into the transmission 3 for excess pressure protection.

The device of FIG. 1 has a further pressure switch 39 that is in line-connection with the leak oil lines 30, 36. This pressure switch 39 opens when a predetermined pressure is exceeded. Therefore, it can serve to detect a pressure increase in the leak oil lines 30, 36, from which conclusions can be drawn as to a possible functional defect of the hydraulic drives 5, 5' or the hydraulic swing motor 61.

During operation of the device illustrated in FIG. 1 the hydraulic drives 5, 5' are acted upon by pressurized fluid via the supply lines 51, 51' and drive the transmission 3. The fluid delivered by the hydraulic drives 5, 5' is discharged via the return-flow lines 50, 50'. At least a part of the back-flowing fluid is supplied as a lubricant via the lubrication line 10 to the transmission 3. The dosing pump 16 that is connected mechanically with the transmission 3 ensures in this case that an amount of lubricant depending on the rotational speed is supplied to the transmission 3. At the same time lubricant is discharged in the bottom portion of the transmission 3 via the lubricant return line 20. By means of the lubricant return pump 26, which is also connected mechanically with the transmission 3, the amount of lubricant discharged is set depending on the rotational speed of the transmission.

The invention claimed is:

1. A construction machine for generating vibrations, the construction machine comprising:

a transmission having gears and a drive shaft, at least one unbalanced mass arranged on the transmission for generating vibrations, at least one hydraulic drive arranged on the drive shaft of the transmission for driving the gears, a hydraulic circuit including at least one supply line for supplying hydraulic fluid to the at least one hydraulic drive for operating the at least one hydraulic drive and at least one return-flow line for discharging hydraulic fluid from the at least one hydraulic drive, at least one lubrication line branching off from and in line-connection with the at least one return-flow line of the hydraulic circuit and being operatively connected to the transmission for supplying hydraulic fluid to the gears of the transmission for lubricating the gears, a dosing device positioned in the at least one lubrication line, the dosing device operative to change the supply of the hydraulic fluid through the at least one lubrication line between the hydraulic circuit and the transmission depending on the rotational speed of the gears of the transmission, and a leak oil line for discharging leak oil from the hydraulic drive.

2. The construction machine according to claim 1, wherein the dosing device has a dosing pump that is coupled mechanically to the transmission.

3. The construction machine according to claim 2, further comprising a leak oil line for discharging leak oil from the dosing pump.

4. The construction machine according to claim 1, wherein a lubricant return device is provided, with which lubricant can be discharged from the transmission depending on the rotational speed of the gears of the transmission.

5. The construction machine according to claim 3, wherein the lubricant return device includes at least one lubricant return line fluid connected with the transmission for returning lubricant from the transmission, and a lubricant return pump arranged on the at least one lubricant return line, wherein the lubricant return pump is coupled mechanically to the transmission.

6. The construction machine according to claim 5, further comprising a pressure-limiting valve and a relief line connected to the lubricant return line via the pressure-limiting valve, with the relief line leading into the transmission.

7. The construction machine according to claim 1, further comprising a pressure-limiting valve and a relief line connected to the at least one lubrication line, via the pressure-limiting valve, with the relief line leading into the transmission.

8. The construction machine according to claim 1, the at least one hydraulic drive comprising two hydraulic drives and the hydraulic circuit having two respective return-flow lines.

9. The construction machine according to claim 1, wherein a pressure switch is provided on the at least one lubrication line.

10. The construction machine according to claim 9, wherein the pressure switch is provided in the at least one lubrication line on the side of the dosing pump facing towards the transmission.

11. The construction machine according to claim 1, further comprising at least one unbalanced mass arranged on the transmission.

12. The construction machine according to claim 1, wherein the hydraulic drive is a hydraulic motor.

13. A construction machine for generating vibrations, the construction machine comprising:

a transmission having gears and a drive shaft, at least one unbalanced mass arranged on the transmission for generating vibrations, at least one hydraulic drive arranged on the drive shaft of the transmission for driving the gears, a hydraulic circuit including at least one supply line for supplying hydraulic fluid to the at least one hydraulic drive for operating the at least one hydraulic drive and at least one return-flow line for discharging hydraulic fluid from the at least one hydraulic drive, at least one lubrication line branching off from and in line-connection with the at least one return-flow line of the hydraulic circuit and being operatively connected to the transmission for supplying hydraulic fluid to the gears of the transmission for lubricating the gears, a dosing device positioned in the at least one lubrication line, the dosing device operative to change the supply of the hydraulic fluid through the at least one lubrication line between the hydraulic circuit and the transmission depending on the rotational speed of the gears of the transmission, a lubricant return device, with which lubricant can be discharged from the transmission depending on the rotational speed of the gears of the transmission, wherein the lubricant return device includes at least one lubricant return line fluid connected with the transmission for returning lubricant from the transmission, and a lubricant return pump arranged on the at least one lubricant return line, wherein the lubricant return pump is coupled mechanically to the transmission, wherein the lubricant return pump has an output side, and a balancing line branched off from the lubricant return line on the output side of the lubricant return pump, the balancing line leading into the transmission.

14. The construction machine according to claim 13, further comprising a throttle in the balancing line.

15. A method for producing a sheet pile wall, in which sheet piles are acted upon by a mechanical vibration and driven into the ground by means of a construction machine according to claim 1.

16. A construction machine for generating vibrations, the construction machine comprising:

a transmission having gears and a drive shaft, at least one unbalanced mass arranged on the transmission for generating vibrations, at least one hydraulic drive arranged on the drive shaft of the transmission for driving the gears, a hydraulic circuit including at least one supply line for supplying hydraulic fluid to the at least one hydraulic drive for operating the at least one hydraulic drive and at least one return-flow line for discharging hydraulic fluid from the at least one hydraulic drive, at least one lubrication line branching off from and in line-connection with the at least one return-flow line of the hydraulic circuit and being operatively connected to the transmission for supplying hydraulic fluid to the gears of the transmission for lubricating the gears, a dosing device positioned in the at least one lubrication line, the dosing device operative to change the supply of the hydraulic fluid through the at least one lubrication line between the hydraulic circuit and the transmission depending on the rotational speed of the gears of the transmission, wherein the dosing device has a dosing pump that is coupled mechanically to the transmission, a leak oil line for discharging leak oil from the dosing pump, a pressure-limiting valve, and a relief line connected to the leak oil line via the pressure-limiting valve, with the relief line leading into the transmission.

* * * * *